US006840012B2

(12) United States Patent
Dufour et al.

(10) Patent No.: US 6,840,012 B2
(45) Date of Patent: Jan. 11, 2005

(54) RAIL-LESS CABLE-DRIVEN WINDOW GLASS LIFTER

(75) Inventors: Fabien Dufour, Chateauneuf/Loire (FR); Marcel Leveille, Sully sur Loire (FR)

(73) Assignee: ArvinMeritor Light Vehicle Systems - France (FR)

( * ) Notice: Subject to any disclaimer, the term of this patent is extended or adjusted under 35 U.S.C. 154(b) by 0 days.

(21) Appl. No.: 10/281,382

(22) Filed: Oct. 25, 2002

(65) Prior Publication Data

US 2003/0097795 A1 May 29, 2003

(30) Foreign Application Priority Data

Oct. 26, 2001 (FR) ..... 01 13873

(51) Int. Cl.[7] ..... E05F 11/48
(52) U.S. Cl. ..... 49/352; 49/348; 49/506
(58) Field of Search ..... 49/352, 502, 349, 49/348, 372, 374, 506

(56) References Cited

U.S. PATENT DOCUMENTS

| | | | | | |
|---|---|---|---|---|---|
| 2,987,937 | A | | 6/1961 | Sala | |
| 4,110,935 | A | | 9/1978 | Sessa | |
| 4,905,412 | A | * | 3/1990 | Srock et al. | 49/352 |
| 4,920,697 | A | * | 5/1990 | Vail et al. | 49/348 |
| 4,970,827 | A | * | 11/1990 | Djordjevic | 49/349 |
| 5,309,679 | A | * | 5/1994 | Ward | 49/352 |
| 5,469,668 | A | * | 11/1995 | Heim et al. | 49/502 |
| 5,685,111 | A | * | 11/1997 | Zimmerer et al. | 49/352 |
| 5,855,093 | A | * | 1/1999 | Medebach | 49/352 |
| 5,964,063 | A | * | 10/1999 | Hisano et al. | 49/502 |
| 6,119,400 | A | * | 9/2000 | Ovenshire | 49/352 |
| 6,655,092 | B2 | * | 12/2003 | Pacella et al. | 49/506 |
| 2002/0083647 | A1 | * | 7/2002 | Bostian et al. | 49/352 |
| 2003/0029092 | A1 | * | 2/2003 | Bertolini et al. | 49/352 |

FOREIGN PATENT DOCUMENTS

DE 4423132 A 1/1996

OTHER PUBLICATIONS

French Search Report dated Jul. 23, 2002.

* cited by examiner

*Primary Examiner*—Gregory J. Strimbu
(74) *Attorney, Agent, or Firm*—Carlson, Gaskey & Olds

(57) ABSTRACT

A rail-less window lifter includes a linking member linking a window glass and a cable. The linking member is positioned with respect to the window glass at a location that avoid jamming of the window glass during raising. The linking member applies a force to the window glass at a single lifting point.

12 Claims, 2 Drawing Sheets

RAIL-LESS CABLE-DRIVEN WINDOW GLASS LIFTER

This application claims priority to French Patent Application Number FR 01 13 873 filed on Oct. 26, 2001.

BACKGROUND OF THE INVENTION

The present invention relates to automobile cable-driven window lifters, and in particular to cable-driven window lifters with a linking member between the cable and a window glass which is not guided by rails, of the simple lift type.

In simple lift window lifters, the raising movement of the window glass is only generated by a cable that is rigidly fixed to the linking member.

Generally, window lifters employing a carrier that is guided in a rail are more complicated and more expensive than rail-less window lifters.

U.S. Pat. No. 2,987,937 discloses a window lifter that does not have a guide rail. The window lifter includes two pulleys, one of which is driven by a motor. These pulleys are mounted rotatively on a rigid support and separated by an axial distance. A cable is slipped into a respective groove of each pulley. The cable carries a linking member between the cable and the window glass. Depending on the direction of rotation of the motor, the linking member is driven upwardly or downwardly. The United States Patent does not specify whether the window lifter is of the simple lift type or double lift type.

SUMMARY OF THE INVENTION

There is consequently a need for a single lift window lifter, with no rail, which allows a linking member to be secured to a window glass that prevents jamming during lifting.

The invention consequently provides a rail-less window lifter with a single lifting member including a cable, a window glass guide frame, a window glass, and a linking member that renders the cable and window glass integral, applying a force to the window glass while it is being raised, in which:

- A is a front lower point of contact of the window glass with the frame;
- B is a tear upper point of contact of the window glass with the frame;
- G is the center of gravity of the window glass;
- C is the point where said linking member applies force to the window glass;
- F is the magnitude of the force applied by the linking member to the window glass;
- tan $\phi$ is the coefficient of friction between the window glass and the window glass lifter;
- $\beta$ is the angle of inclination of a window glass guiding part with respect to the vertical;
- P is a magnitude of weight applied to the window glass;
- $\vec{y}$ is a unit vector directed in the vertical direction defined by gravity;
- $\vec{x}$ is a unit vector directed along the horizontal direction;
- Rar is the magnitude of the force of the frame on the window glass at point B, equal to $(P-F.(\sin\beta.\tan(\beta+\phi)+\cos\beta))/(\sin(\beta-\phi)-\cos(\beta-\phi).\tan(\beta+\phi))$;

The position of said point C being defined such that:

$$|\vec{AG}\cdot\vec{x}| \geq |\vec{AC}\cdot\vec{x}| \geq \frac{\left(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi)\right)}{(F\cdot\cos\varphi)}$$

According to one embodiment, the position of point C is defined such that:

$$|\vec{AG}\cdot\vec{x}| > |\vec{AC}\cdot\vec{x}| \geq \frac{\left(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi)\right)}{(F\cdot\cos\varphi)}$$

According to yet a further embodiment, J being an assembly tolerance greater than 10 mm, and the position of point C is defined such that:

$$|\vec{AG}\cdot\vec{x}|-J>|\vec{AC}\cdot\vec{x}|$$

According to a further embodiment, M being an assembly tolerance greater than 10 mm, and the position of point C is defined such that:

$$|\vec{AC}\cdot\vec{x}| \geq M+\frac{\left(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi)\right)}{(F\cdot\cos\varphi)}$$

According to yet a further embodiment, the window lifter additionally includes a further linking member which renders the window glass and cable integral exercising a lowering force on the window glass in which D is the point of application of force of the other linking member on the window glass, and the position of point D is defined such that:

$$|\vec{AD}\cdot\vec{x}|\geq|\vec{AG}\cdot\vec{x}|$$

The invention also provides a method for assembling a rail-less window lifter of the simple lift type including the steps of providing a cable, a guide frame for the window glass, a window glass, and linking member for exercising a lifting force on the window glass. The method further includes the step of rendering the linking member integral with the window glass to apply force thereto at a point C, and the position of said point C is defined by:

$$|\vec{AG}\cdot\vec{x}| \geq |\vec{AC}\cdot\vec{x}| \geq \frac{\left(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi)\right)}{(F\cdot\cos\varphi)}$$

for a mounted window lifter:

- A is a front lower pint of contact of the window glass with the frame;
- B is a rear upper point of contact of the window glass with the frame;
- G is the center of gravity of the window glass;
- C is the point where said linking member applies force to the window glass;
- F is the magnitude of the force applied by the linking member to the window glass;

tan $\phi$ is the coefficient of friction between the window glass and the window glass lifter;

$\beta$ is the angle of inclination of a window glass guiding part with respect to the vertical;

P is a magnitude of weight applied to the window glass;

$\vec{y}$ is a unit vector directed in the vertical direction defined by gravity;

$\vec{x}$ is a unit vector along the horizontal directions.

The method further includes the steps of securing the cable to the linking member and inserting the window glass into the window glass guiding frame.

In one embodiment of the method, the position of point C is defined such that:

$$|\vec{AG}\cdot\vec{x}| > |\vec{AC}\cdot\vec{x}| \geq \frac{\left(|\vec{AG}\cdot\vec{x}|\cdot P - |\vec{AB}\cdot\vec{x}|\cdot Rar\cdot\sin(\beta-\varphi) - |\vec{AB}\cdot\vec{y}|\cdot Rar\cdot\cos(\beta-\varphi)\right)}{(F\cdot\cos\varphi)}$$

In a further embodiment of the method, J is an assembly tolerance greater than 10 mm, and the position of point C is defined such that:

$$|\vec{AG}\cdot\vec{x}| - J > |\vec{AC}\cdot\vec{x}|$$

In a further embodiment of the method, M an assembly tolerance greater than 10 mm, and the position of point C is defined such that:

$$|\vec{AC}\cdot\vec{x}| \geq M + \frac{\left(|\vec{AG}\cdot\vec{x}|\cdot P - |\vec{AB}\cdot\vec{x}|\cdot Rar\cdot\sin(\beta-\varphi) - |\vec{AB}\cdot\vec{y}|\cdot Rar\cdot\cos(\beta-\varphi)\right)}{(F\cdot\cos\varphi)}$$

According to yet a further embodiment, the method further includes the steps of providing an additional linking member exercising a lowering force on the window glass. rendering the additional linking member integral with the window glass for exercising a lowering force on it at a point D, and the position of the point D is defined by:

$$|\vec{AD}\cdot\vec{x}| \geq |\vec{AG}\cdot\vec{x}|$$

Further characteristics and advantages of the invention will become more clear from the description which follows of some embodiments of the invention provided by way of example and with reference to the attached drawings.

DETAILED DESCRIPTION OF PREFERRED EMBODIMENTS

A rail-less window lifter of the simple lift type includes a linking member between a window glass and a cable positioned with respect to the window glass such that jamming of the window glass while it is being raised is avoided.

Figure 1:
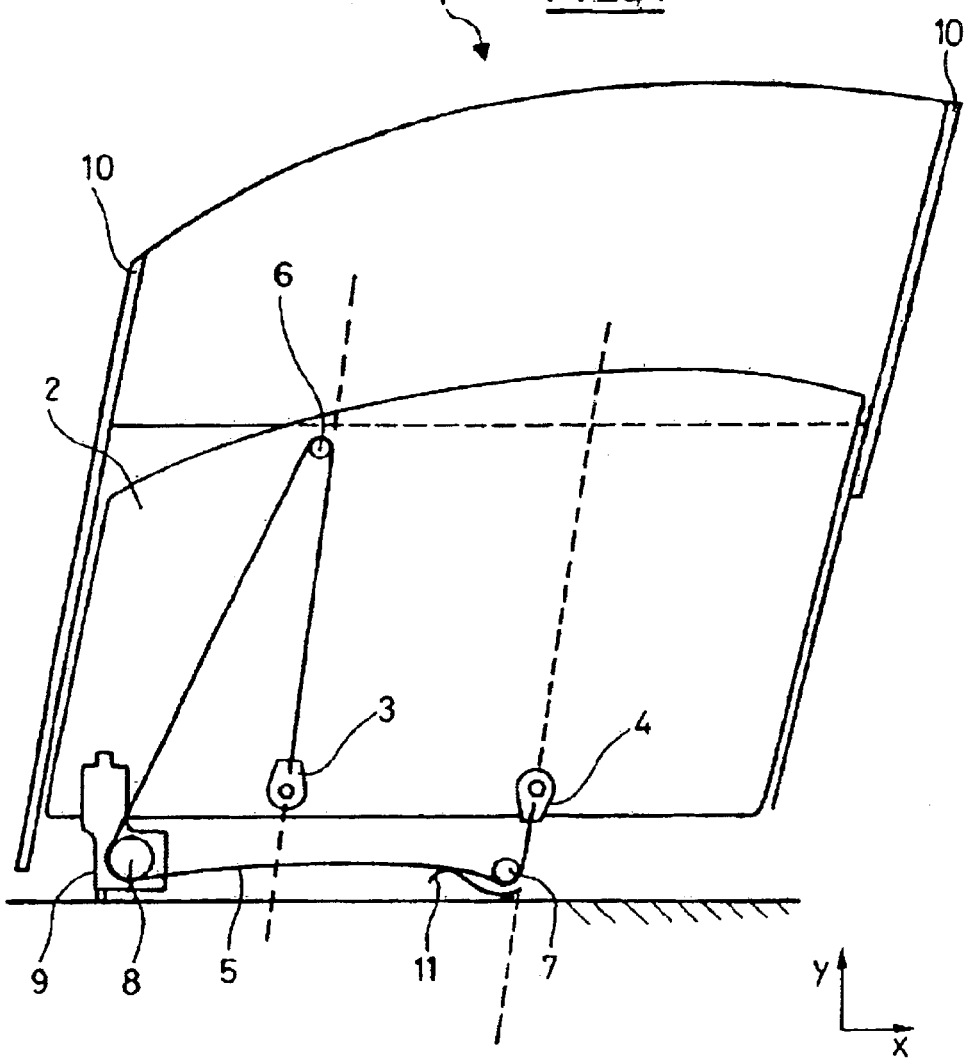
FIG. 1 is a diagrammatic view of one embodiment of the window lifter according to the invention.

FIG. 1 shows, diagrammatically, the inside of a vehicle door according to the invention. The vehicle door 1 includes the window lifter. The window lifter includes a window glass 2 secured to linking members 3 and 4, a cable connecting the linking members 3 and 4, direction-changing pulleys 6 and 7 over which the cable 5 passes, and a drum 8 for driving the cable 5 coupled to a motor 9. The window lifter further includes a guide frame 10 for the window glass 2 and a cable tensioner 11.

The window lifter is of the simple lift type as that part of the cable 5 extending between linking member 3 and pulley 6 is the only connecting element which exercises a lifting force on window glass 2.

Figure 2:
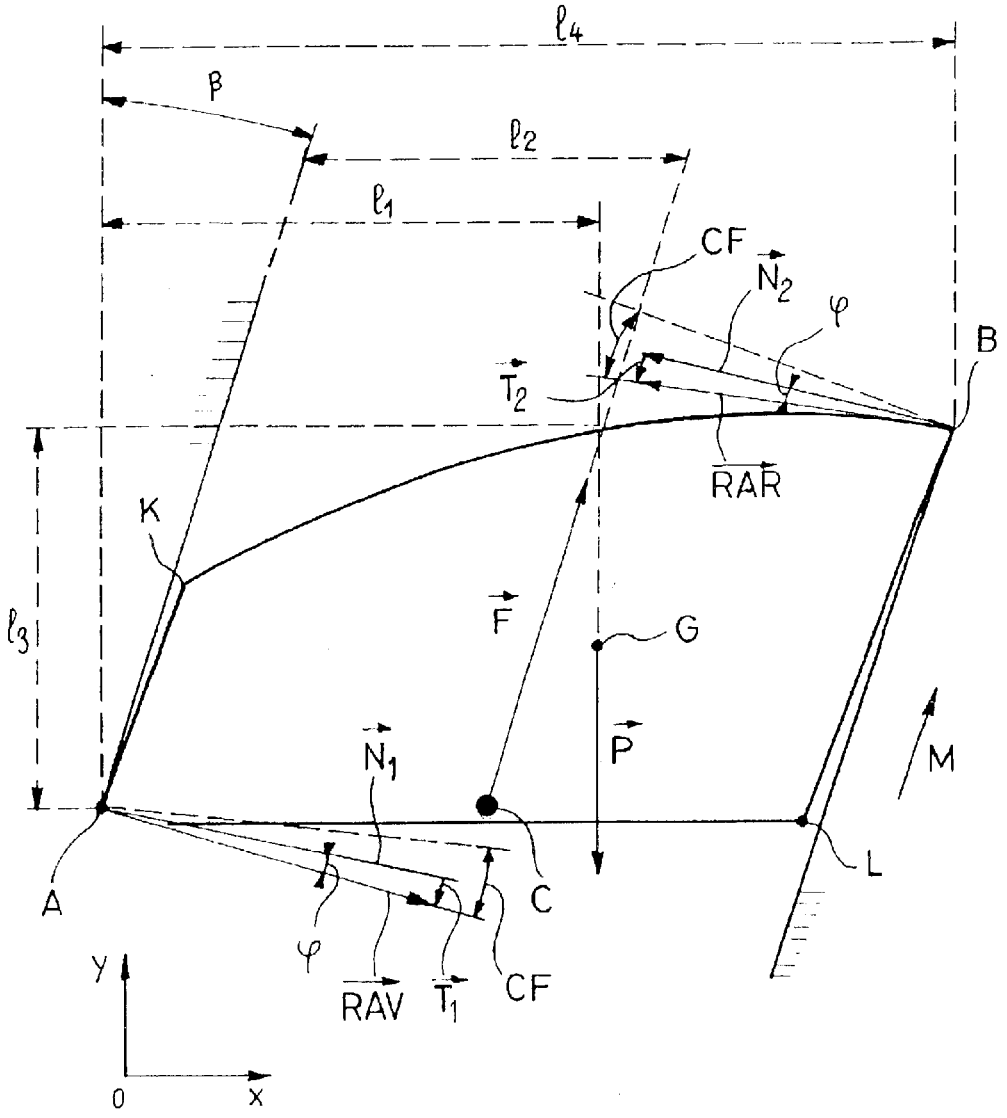
FIG. 2 shows the forces acting on the window glass of FIG. 1.

According to the invention, the line of action of the linking member 3 on the window glass 2, which is determined by the direction of the cable 5, is offset from the center of gravity G, as shown in FIG. 2. This line of action is nevertheless at some distance from the edge of the window glass 2 to ensure the latter does not get jammed in the frame 10 when the window glass 2 is being raised. Relative securing between the linking member 3 and a window glass 2 can thus be achieved with relatively less strict locational requirements, or with assembly tolerance.

The window glass frame 10 includes, for example, a guide rail in which the window glass 2 slides.

We shall now define the region where the linking member 3 is placed with respect to the window glass 2 to prevent the window glass 2 from jamming in the frame 10. The various elements of the calculations are identified in FIG. 2.

The lower front corner of the window glass is illustrated as A, the rear lower corner of the window glass as L, the front upper corner of the window glass as K and the rear upper corner as B. Point G corresponds to the center of gravity of the window glass, including the linking member or members. The contact between the window glass 2 and window glass frame 10 occurs at A and B. The coefficient of friction at A and at B is identical. The person skilled in the art will obviously be able to adapt the calculations to the case where the frictional coefficients are different. Axis X corresponds to the longitudinal axis of the vehicle with the door close. Axis Y corresponds to the vertical axis of the vehicle or the axis that is collinear with the acting force of gravity.

$$L1 = \left|\overrightarrow{AG}\cdot\vec{x}\right|$$

$$L2 = \left|\overrightarrow{AC}\cdot\vec{x}\right|$$

$$L3 = \left|\overrightarrow{AB}\cdot\vec{y}\right|$$

$$L4 = \left|\overrightarrow{AB}\cdot\vec{x}\right|$$

$\beta$ is the mean angle of inclination of the window glass guiding part.

The forces applied to the window glass in the (x, y) plane are as follows:

$\overrightarrow{Rav}$ is the force applied at point A on the window glass by the window frame.

$\overrightarrow{Rar}$ is the force applied at point B on the window glass by the window frame.

$\overrightarrow{P}$ represents the weight applied to the complete window glass.

$\overrightarrow{F}$ represents the drive force applied at points C on the window glass.

In the (x, y) reference frame, these forces have the following components:

$$\overrightarrow{Rav}\left|\begin{array}{l} Rav.\cos(\beta+\varphi) \\ -Rav.\sin(\beta+\varphi) \\ 0 \end{array}\right.$$

$$\overrightarrow{Rar}\left|\begin{array}{l} Rar.\cos(\beta-\varphi) \\ -Rar.\sin(\beta-\varphi) \\ 0 \end{array}\right.$$

$$\overrightarrow{P}\left|\begin{array}{l} 0 \\ -P \\ 0 \end{array}\right.$$

$$\overrightarrow{F}\left|\begin{array}{l} 0 \\ F.\sin\beta \\ F.\cos\beta \\ 0 \end{array}\right.$$

The coefficient of friction f is equal to tan ϕ. We can also define the frictional cones at A and at B. Forces at A and B should be kept outside of these cones to ensure the window glass slides without jamming.

The equilibrium conditions for which the window glass gets blocked by jamming are:

Σ(external forces)=zero

Σ(Moments with respect to point A)=zero

We thus obtain the following equations:

(a): Rav*Cos(β+ϕ)+$F$*sin β−Rar*cos(β−ϕ)=0

(b):−Rav*sin(β+ϕ)+$F$*cos β+Rar+sin(β−ϕ)=0

(c): $L2$*sin β−$L1$* $P$+$L4$*Rar*cos(β−ϕ)+$L3$*Rar*cos(β−ϕ)=0

For raising the window glass, with L2<L1, condition on L2 can be deduced from these equations making it possible to obtain sliding of the window glass:

$L2$≧($L1$ *$P$−$L4$*Rar*sin(β−ϕ)−$L3$*Rar*cos(β−ϕ))/($F$.cos β)

By calculation, we obtain:

Rar=($P$−$F$.(sin β.tan(β+Φ)+cos β))/(sin(β−Φ)-cos(β−Φ).tan(β+Φ))

Generally speaking, for raising the window glass, we avoid the case where L2>L1 as the window glass then will get jammed at the corners K and L.

For a window glass lowering force F, with L2>L1, movement is guaranteed until L2=L1.

For a window glass lowering force F, with L2<L1, jamming of the window glass occurs at the corners K and L.

Preferably, the linking member that is exercising a lifting force is situated so that the following relations holds:

$L2$≧($L1$ *$P$−$L4$*Rar*sin(β−ϕ)−$L3$*Rar*cos(β−ϕ))/($F$. cos β)

To guarantee with a greater margin of security and the lifting of the window glass without jamming, the following strict inequality can be provided:

$L2$>($L1$ *$P$−$L4$*rar*sin(β−ϕ)−$L3$*Rar*cos(β−ϕ))/($F$. cosβ)

An assembly tolerance J, with respect to the line of action of the weight passing through G, greater than 10 mm can be provided. The following inequality, as a function of the tolerance J chosen, for positioning the linking member, can be employed:

L1−J>L2.

An assembly tolerance M with respect to the limit point for jamming, which is greater than 10 mm can be provided. Further, the following inequality as a function of the tolerance M selected, for positioning the linking member, can be employed:

$L2$>$M$+($L1$*$P$−$L4$*Rar*sin(β−ϕ)−$L3$*Rar*cos(β−ϕ))/($F$. cos β)

Where inclination β varies, in particular when the lifting path of travel is curved with respect to the (x,y) plane, the value of β which is the most unfavourable for jamming is employed in the calculations for the positioning of the linking member. This consequently ensures that the window glass can be raised without jamming.

It will also be understood that the position of point C is a modelling of the application of forces to the window glass for a linking member of a certain width.

The invention also relates to a method for assembling a window lifter.

In the method for assembling a rail-less window lifter of the simple lift type, the method includes the steps of providing a cable, a guide frame for the window glass, a window glass, and a linking member for exercising a lifting force on the window glass, and rendering the linking member integral with the window glass to apply a force thereto at a point C, the position of the point C being defined by:

$$\left|\overrightarrow{AG}\cdot\vec{x}\right| \geq \left|\overrightarrow{AC}\cdot\vec{x}\right| \geq \frac{\left(\left|\overrightarrow{AG}\cdot\vec{x}\right|\cdot P-\left|\overrightarrow{AB}\cdot\vec{x}\right|\cdot Rar\cdot\sin(\beta-\varphi)-\left|\overrightarrow{AB}\cdot\vec{y}\right|\cdot Rar\cdot\cos(\beta-\varphi)\right)}{(F\cdot\cos\varphi)}$$

for a mounted window lifter,

A being a front lower point of contact of the window glass with the frame;

B being a rear upper point of contact of the window glass with the frame;

G being the center of gravity of the window glass;

C being the point where said linking member applies force to the window glass;

F being the magnitude of the force applied by the linking member to the window glass;

tan ϕ being the coefficient of friction between the window glass and the window glass lifter;

β being the angle of inclination of a window glass guiding part with respect to the vertical;

P being a magnitude of weight applied to the window glass;

$\vec{y}$ being a unit vector directed in the vertical direction defined by gravity;

$\vec{x}$ being a unit vector directed along the horizontal direction;

The method further includes the steps of securing the cable to the linking member and inserting the window glass into the window glass guiding frame.

One can obviously employ the other limiting values set out above for locating the linking member with respect to the window glass.

Obviously, the present invention is not limited to the examples and embodiments described and illustrated, but may be subject to numerous variations available to those skilled in the art.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

What is claimed is:

1. A rail-less window lifter, comprising:

a cable;

a window glass guide frame;

a window glass;

a linking member attached to the window glass and the cable and, applying a force to the window glass while the window glass is being raised, wherein A is a front lower point of contact of the window glass with the window glass guide frame;

B is a rear upper point of contact of the window glass with the window glass guide frame;

G is the center of gravity of the window glass;

C is a point where said linking member applies the force to the window glass;

F is the magnitude of the force applied by the linking member to the window glass;

tan $\phi$ is the coefficient of friction between the window glass and the window glass guide frame;

$\beta$ is an angle of inclination of the window glass guide part with respect to a vertical direction;

P is a force of gravity applied to a mass of the window glass;

$\vec{y}$ is a unit vector directed in the vertical direction defined by gravity;

$\vec{x}$ is a unit vector directed along a horizontal direction;

Rar is a magnitude of a force of the frame on the window glass at the point B, equal to $(P-F\cdot(\sin\beta\cdot\tan(\beta+\phi)+\cos\beta))/(\sin(\beta-\phi)-\cos(\beta-\phi)\cdot\tan(\beta+\phi))$;

a position of C is defined such that:

$$|\vec{AG}\cdot\vec{x}| \geq |\vec{AC}\cdot\vec{x}| \geq \frac{(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi))}{(F\cdot\cos\varphi)}.$$

2. The window lifter of claim 1, wherein the position of the point C is defined such that:

$$|\vec{AG}\cdot\vec{x}| > |\vec{AC}\cdot\vec{x}| \geq \frac{(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi))}{(F\cdot\cos\varphi)}.$$

3. The window lifter of claim 2, wherein J is an assembly tolerance greater than 10 mm, and the position of the point C is defined such that:

$$|\vec{AG}\cdot\vec{x}|-J>|\vec{AC}\cdot\vec{x}|.$$

4. The window lifter according to claim 3, wherein M is an assembly tolerance greater than 10 mm, and the position of the point C is defined such that:

$$|\vec{AC}\cdot\vec{x}| \geq M+\frac{(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi))}{(F\cdot\cos\varphi)}.$$

5. The window lifter according to claim 2, wherein M is an assembly tolerance greater than 10 mm, and the position of the point C is defined such that:

$$|\vec{AC}\cdot\vec{x}| \geq M+\frac{(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi))}{(F\cdot\cos\varphi)}.$$

6. The window lifter according to claim 1, further comprising a second linking member attached to the window glass and the cable, the second linking member exercising a lowering force on the window glass while the window glass is being raised, wherein D is a point of application of the force of the second linking member on the window glass, and the position of the point D is defined such that:

$$|\vec{AD}\cdot\vec{x}| \geqq |\vec{AG}\cdot\vec{x}|.$$

7. A method for assembling a rail-less window lifter, comprising the steps of:

providing a cable, a window glass, a guide frame for the window glass, and a window glass linking member for exercising a lifting force on the window glass;

securing the linking member to the window glass to apply the force at a point C, a position of the point C defined by:

$$|\vec{AG}\cdot\vec{x}| \geq |\vec{AC}\cdot\vec{x}| \geq \frac{(|\vec{AG}\cdot\vec{x}|\cdot P-|\vec{AB}\cdot\vec{x}|\cdot Rar\cdot\sin(\beta-\varphi)-|\vec{AB}\cdot\vec{y}|\cdot Rar\cdot\cos(\beta-\varphi))}{(F\cdot\cos\varphi)}$$

wherein for a mounted window lifter,

A is a front lower point of contact of the window glass with the window glass guide frame;

B is a rear upper point of contact of the window glass with the window glass guide frame;

G is the center of gravity of the window glass;

F is the magnitude of the force applied by the linking member to the window glass;

tan $\phi$ is the coefficient of friction between the window glass and the window glass guide frame;

β is an angle of inclination of the window glass guide frame with respect to a vertical direction;

P is a force of gravity applied to a mass of the window glass;

$\vec{y}$ is a unit vector directed in the vertical direction defined by gravity;

$\vec{x}$ is a unit vector directed along a horizontal direction;

securing the cable to the linking member; and inserting the window glass into the window glass guide frame.

8. The method according to claim 7, wherein the position of the point C is defined such that:

$$\left|\vec{AG}\cdot\vec{x}\right| > \left|\vec{AC}\cdot\vec{x}\right| \geq \frac{\left(\left|\vec{AG}\cdot\vec{x}\right|\cdot P - \left|\vec{AB}\cdot\vec{x}\right|\cdot Rar\cdot\sin(\beta-\varphi) - \left|\vec{AB}\cdot\vec{y}\right|\cdot Rar\cdot\cos(\beta-\varphi)\right)}{(F\cdot\cos\varphi)}.$$

9. The method according to claim 8, wherein J is an assembly tolerance greater than 10 mm, and the position of the point C is defined such that:

$$|\vec{AG}\cdot\vec{x}|-J>|\vec{AC}\cdot\vec{x}|.$$

10. The method according to claim 9, wherein M is an assembly tolerance greater than 10 mm, and the position of the point C is defined such that:

$$\left|\vec{AC}\cdot\vec{x}\right| \geq M + \frac{\left(\left|\vec{AG}\cdot\vec{x}\right|\cdot P - \left|\vec{AB}\cdot\vec{x}\right|\cdot Rar\cdot\sin(\beta-\varphi) - \left|\vec{AB}\cdot\vec{y}\right|\cdot Rar\cdot\cos(\beta-\varphi)\right)}{(F\cdot\cos\varphi)}.$$

11. The method according to claim 8, wherein M is an assembly tolerance greater than 10 mm, and the position of the point C is defined such that:

$$\left|\vec{AC}\cdot\vec{x}\right| \geq M + \frac{\left(\left|\vec{AG}\cdot\vec{x}\right|\cdot P - \left|\vec{AB}\cdot\vec{x}\right|\cdot Rar\cdot\sin(\beta-\varphi) - \left|\vec{AB}\cdot\vec{y}\right|\cdot Rar\cdot\cos(\beta-\varphi)\right)}{(F\cdot\cos\varphi)}.$$

12. The method according to claim 7, wherein the method further comprises the steps of providing a second linking member exercising a lowering force on the window glass and securing the second linking member to the window glass for exercising the lowering force at a point D, and a position of the point D is defined by:

$$|\vec{AD}\cdot\vec{x}|\geqq|\vec{AG}\cdot\vec{x}|.$$

* * * * *

UNITED STATES PATENT AND TRADEMARK OFFICE

CERTIFICATE OF CORRECTION

PATENT NO. : 6,840,012 B2
DATED : January 11, 2005
INVENTOR(S) : Dufour et al.

It is certified that error appears in the above-identified patent and that said Letters Patent is hereby corrected as shown below:

Column 8,
Line 40, "≧" should be -- ≥ --.

Column 10,
Line 26, of the issued patent, "≧" should be -- ≥ --.

Signed and Sealed this

Nineteenth Day of April, 2005

JON W. DUDAS
*Director of the United States Patent and Trademark Office*